US007066124B2

(12) United States Patent
Aoyama

(10) Patent No.: US 7,066,124 B2
(45) Date of Patent: Jun. 27, 2006

(54) ENGINE FOR SCOOTER

(75) Inventor: Atsushi Aoyama, Iwata (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 123 days.

(21) Appl. No.: 10/510,318

(22) PCT Filed: Jun. 16, 2003

(86) PCT No.: PCT/JP03/07629

§ 371 (c)(1),
(2), (4) Date: Oct. 4, 2004

(87) PCT Pub. No.: WO04/001213

PCT Pub. Date: Dec. 31, 2003

(65) Prior Publication Data

US 2005/0211213 A1 Sep. 29, 2005

(30) Foreign Application Priority Data

Jun. 21, 2002 (JP) ..... 2002-181341

(51) Int. Cl.
*F01L 1/14* (2006.01)

(52) U.S. Cl. ..... 123/90.48; 123/90.52; 123/90.6; 123/193.4

(58) Field of Classification Search ..... 123/90.48, 123/90.49, 90.52, 90.6, 193.3, 193.4, 90.67; 74/567, 569; 29/888.4, 888.41
See application file for complete search history.

(56) References Cited

U.S. PATENT DOCUMENTS 5,709,180 A * 1/1998 Spath ..... 123/90.16

FOREIGN PATENT DOCUMENTS

| | | |
|---|---|---|
| JP | 61-137812 | 8/1986 |
| JP | 62-237016 | 10/1987 |
| JP | 63-73502 | 5/1988 |
| JP | 6-60705 | 8/1994 |
| JP | 2000-087711 | 3/2000 |
| JP | 2001-123833 | 5/2001 |

* cited by examiner

*Primary Examiner*—Thomas Denion
*Assistant Examiner*—Ching Chang
(74) *Attorney, Agent, or Firm*—Hogan & Hartson, LLP

(57) ABSTRACT

In a scooter engine having valve lifters (33) interposed between intake valves (16) and a cam shaft (31), as well as between exhaust valves (17) and a cam shaft (32), with its axial line (C) of a cylinder (7) extending toward the front part of the vehicle body, a stopper (42) is provided in the cylinder (7) in the opposite position to a top face (33*a*) of the valve lifters (33). The top face (33*a*) of the valve lifters (33) is abutted against the stopper (42) when the valve lifters (33) move to fall off a cylinder head (12) as the cam shaft is removed from the cylinder head (12), thus the valve lifters (33) are prevented from falling off the cylinder (7) by the stopper (42). In this way, the valve lifters (33) are be kept assembled to the cylinder (7) even when the cam shaft is removed during the maintenance work. In other words, the DOHC engine (2) can be installed on a scooter while preventing the valve lifters (33) from falling off in the course of maintenance work.

20 Claims, 5 Drawing Sheets

ENGINE FOR SCOOTER

FIELD OF THE INVENTION

This invention relates to a DOHC engine in a straddle-type vehicle mounted in the manner that cylinder axis line extends toward the front part of a vehicle.

BACKGROUND ART

Conventionally, some four-cycle engines mounted on a type of motorcycle, a scooter, have a cylinder axis line extending toward the front part of a vehicle, with an intake system connected to the upper face of a cylinder head, and with an exhaust pipe connected to its bottom face. A so called SOHC valve system is used in most of the engines of this kind, in which a single cam shaft is made to drive both an intake valve and an exhaust valve. In this type of valve system, the intake valve and the exhaust valve are connected respectively via a rocker arm to an intake valve cam and an exhaust valve cam formed on a cam shaft.

Besides the SOHC described above, there is a DOHC valve system used in a four-cycle engine mounted on other types of motorcycle, in which an intake valve and an exhaust valve are driven respectively by each individual cam shaft. A valve system of the DOHC engine is to be, in general, equipped with a valve lifter taking the shape of a bottomed cylinder at the end of the intake valve and at the end of the exhaust valve respectively, and a cam on an intake cam shaft or on an exhaust cam shaft is closely contacted with the top face of the valve lifter. The valve lifter is slidably fitted into a valve lifter guide hole in a cylinder head, and positioned along the axial line of the intake valve and the exhaust valve. In addition, a thin plate shim is interposed between the internal bottom face of the valve lifter and the intake valve or the exhaust valve for adjusting the gap between the top face and the circular base area of the cam (valve clearance).

It is desired to improve the driving performance of a scooter by adopting the DOHC valve system described above in the scooter engine.

However, when the DOHC engine is mounted on a scooter with its cylinder axial line extending toward the front part of the vehicle, the following problem may arise in trying to perform maintenance work while keeping the engine mounted on the vehicle body in the aforementioned manner and removing the cam shaft.

That is, in the mounted condition described above, each axial line of intake valves and exhaust valves, especially the exhaust valves located at the lower part, and of the valve lifter mounted at the end of the exhaust valve will extend downward to the front. Therefore, when the cam shaft is removed from the cylinder head in the abovementioned condition, no member is available for stopping an exhaust valve lifter, causing the valve lifter to fall off the cylinder head by its own weight. When the valve lifter falls off from the cylinder head, the shim interposed between the valve lifter and the exhaust valve will fall off as well. Since the shim is a smaller part compared with the valve lifter, it can be easily lost if it falls off the cylinder without being recognized by a worker.

SUMMARY OF THE INVENTION

In consideration of the circumstance described above, this invention was made intending to prevent the valve lifters and the shims from falling-off during the maintenance work when the DOHC engine is mounted on a scooter.

This invention is an arrangement that, in a scooter engine having a valve lifters interposed between intake valves and a cam shaft, as well as between exhaust valves and a cam shaft, with its cylinder axis line extending toward the front part of the vehicle body, a stopper opposing to a top face of the valve lifter is provided such that it is secured removably in the cylinder and a gap is maintained between the top face and the stopper when the circular base area on the cam shaft is cam-engaged with the top face of the valve lifter.

According to an embodiment of the present invention, the top face of the valve lifter is abutted against the stopper when the valve lifter moves to fall off the cylinder as the cam shaft is removed from the cylinder, thus the valve lifter is prevented from falling off the cylinder by the stopper. In this way, the valve lifter will be kept assembled to the cylinder even when the cam shaft is removed during maintenance work. In other words, the DOHC engine can be installed on a scooter while preventing the valve lifter from falling off in the course of maintenance work.

In the above-mentioned invention, a shim may be interposed between the intake or exhaust valve and the internal bottom face of the valve lifter.

Here, the shim can be easily lost once it falls off as the valve lifter falls off As described above, however, the valve lifter is prevented from falling off by the stopper, thus the shim is prevented from falling off as well, so as to avoid losing it.

DETAILED DESCRIPTION OF THE INVENTION

Figure 1:
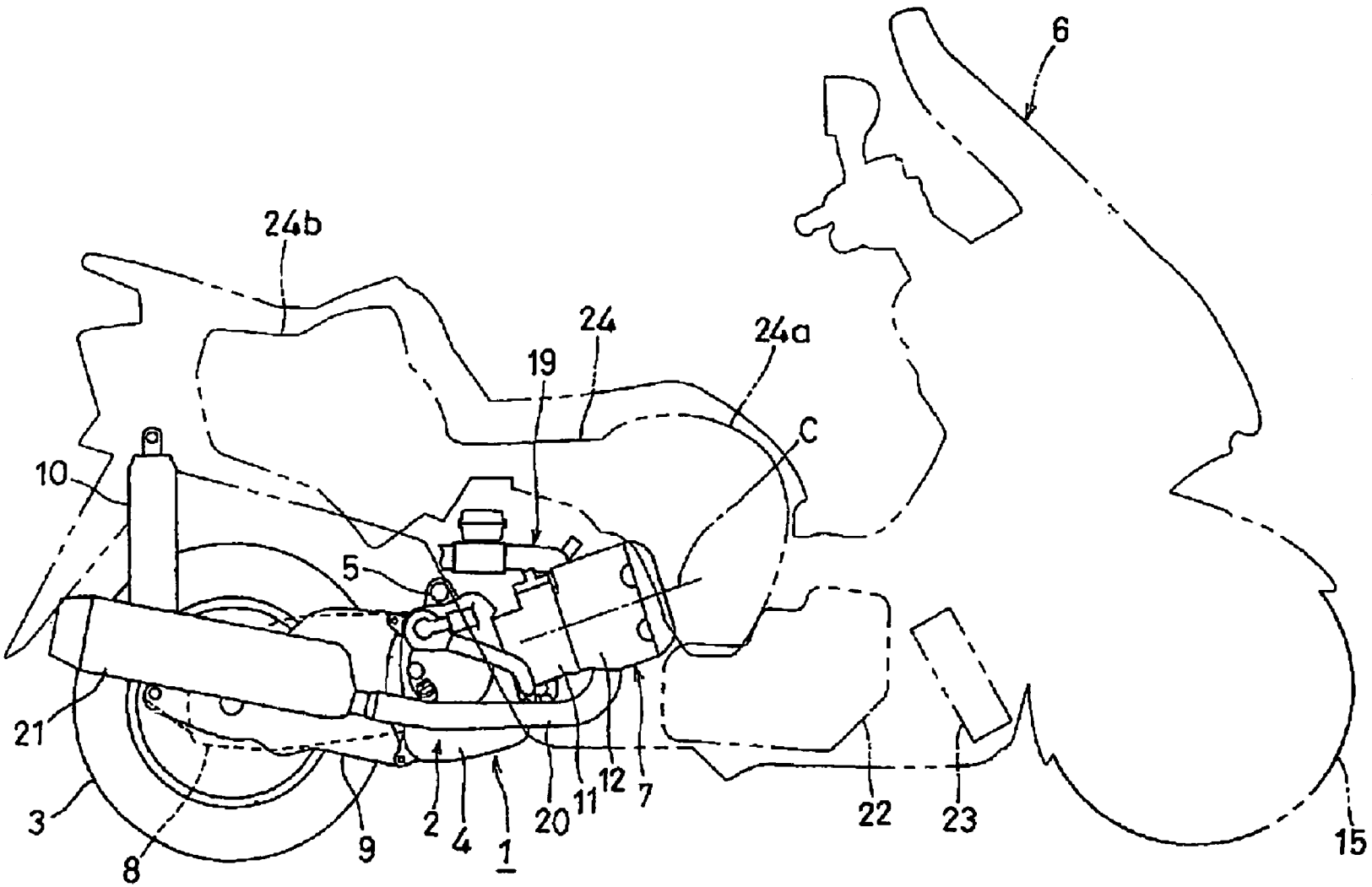
FIG. 1 is a right side view of the unit-swing type power unit for scooters provided with an engine according to this invention.

This invention will be described in detail referring to the attached drawings.

In these figures, the reference numeral 1 denotes a unit-swing type power unit equipped with an engine 2. The power unit 1 integrally incorporates the engine 2 and a rear wheel 3. The power unit 1 is supported in the vertically swingable manner by a vehicle body frame (not shown) of a scooter 6 via a Link (not shown) which is jointed to a joint boss 5 provided at the upper end of a crankcase 4 of the engine 2. Note that the left and the right in the following sections denote the direction in the vehicle width direction of the scooter 6, looking toward the front part of the scooter.

The engine 2 is a water-cooled, single cylinder DOHC engine. The engine 2 is provided with a crankcase 4, and a cylinder 7 projected from the crankcase 4. Also, it is provided with a transmission case 8 extending in the vehicle's longitudinal direction in the area to the left of the rear wheel. The rear wheel 3 is supported by the transmission case 8, and a rear arm 9 located in the area to the right of the rear wheel 3 and extending rearward from the crankcase 4. In addition, the rear end of the transmission case 8 and the rear end of the rear arm 9 are respectively connected to the vehicle frame via a cushion unit 10.

Figure 2:
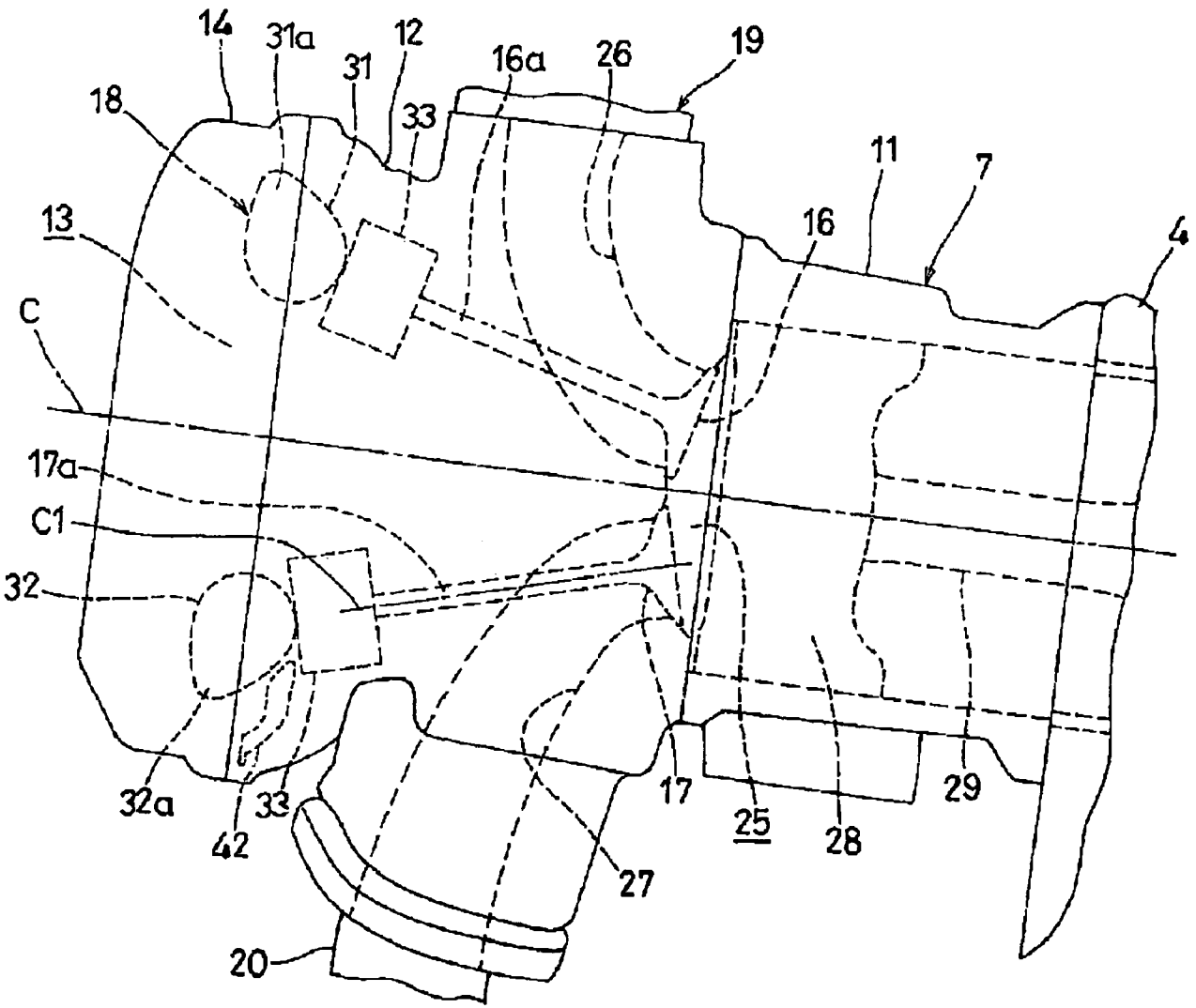
FIG. 2 is a left side view of the cylinder in the engine.

The cylinder 7 includes, as shown in FIG. 1 and FIG. 2, a cylinder body 11 projecting from the crankcase 4 toward the vehicle front and obliquely upward, a cylinder head 12 attached to the front end of the cylinder body 11, and a cylinder head cover 14 attached to the front end of the cylinder head 12, with a valve train cam chamber 13 (refer to the FIG. 2) being formed between the cylinder head 12 and the cylinder head cover 14.

Since the cylinder 7 is projecting from the crankcase 4 toward the vehicle front and obliquely upward, the axis line C of the cylinder 7 is extending in a forward and obliquely upward direction. In this embodiment, the axis line C is slightly inclined upward toward the front part, extending to the point at the vicinity of the upper edge of a front wheel 15.

Figure 4:
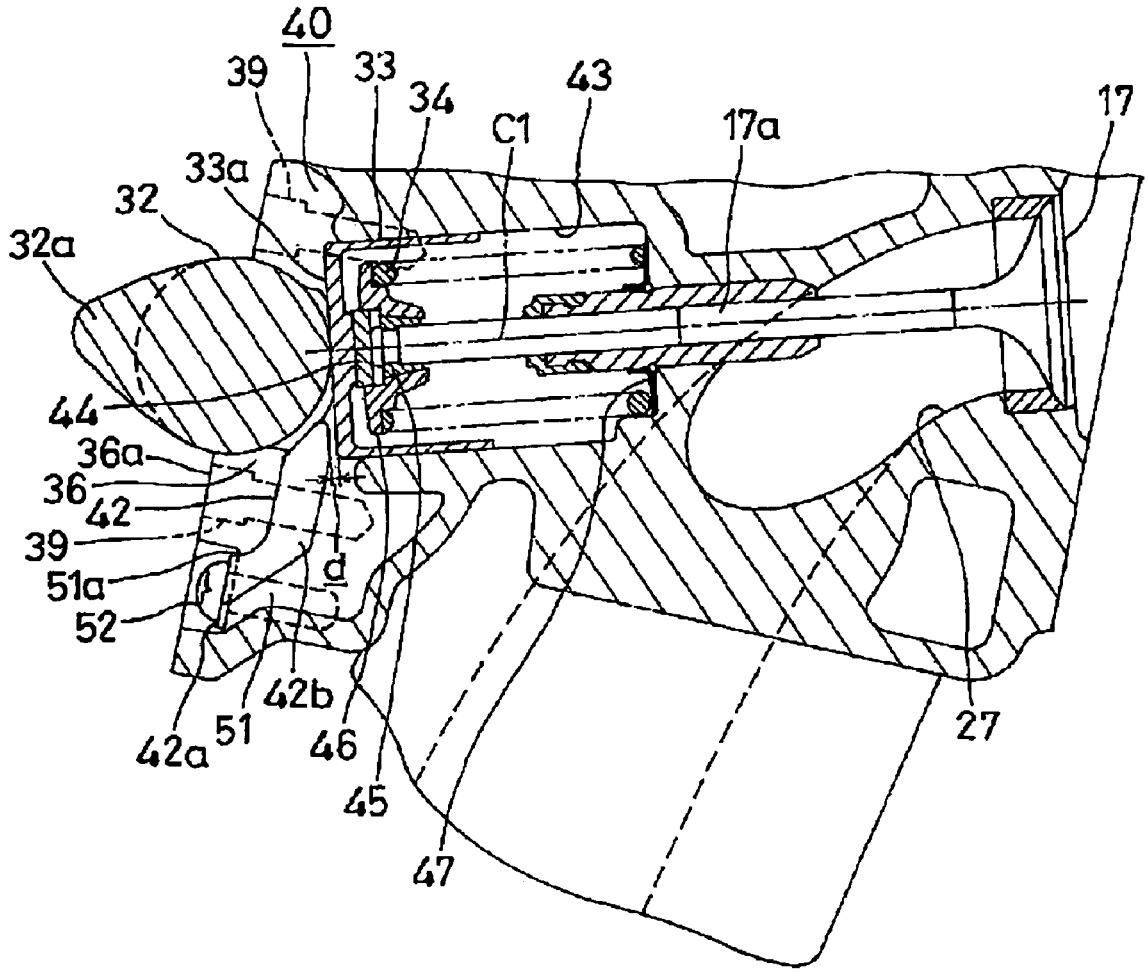
FIG. 4 is a sectional view take along the line VI—VI in FIG. 3, viewed in the direction of arrow.

The cylinder head 12 removably supports two each of the intake valves 16 and the exhaust valves 17, and also supports a valve system 18 for driving these intake valves 16 and the exhaust valves 17, a spark plug (now shown), and the like. An intake system 19 is connected to the upper surface of the cylinder head 12, and an exhaust pipe 20 is connected to its bottom surface. When the engine 2 is mounted on the scooter 6, the axis line C1 of the exhaust valve 17 is inclined to extend downwardly toward the front part, as shown in FIG. 2 and FIG. 4. As shown in FIG. 1, the exhaust pipe 20 is extended rearward from the cylinder head 12 passing along the area to the right of the crankcase 4, and is connected to a muffler 21 in the area to the right of the rear arm 9.

In FIG. 1, the object provided forward of the engine 2 and indicated with a reference numeral 22 represents a fuel tank. Another object located forward of the fuel tank 22 and indicated with a reference numeral 23 represents a radiator. In addition, a storage box 24 is provided above the engine 2. The storage box 24 is formed with the capacity to accommodate 2 (two) helmets (not shown), with its access opening located in the upper part being opened and closed by a seat. The portions within the storage box 24 for accommodating each of the two helmets are shown with reference numerals 24*a* and 24*b*. Further in FIG. 2, the numeral 25 indicates a combustion chamber, 26 indicates an intake port to be opened and closed by the intake valve 16, 27 indicates an exhaust port to be opened and closed by the exhaust valve 17, and 28 and 29 indicate piston and connecting rod1 respectively.

The valve system 18 on the engine 2 is to drive two each of the intake valves 16 and the exhaust valves 17. As shown in FIG. 2 and FIG. 4, the valve system 18 includes components such as an intake cam shaft 31 and an exhaust cam shaft 32 accommodated in the valve train cam chamber 13 and each being arranged to be located above and below the cylinder axis line C, valve lifters 33 with which these cam shafts 31 and 32 are engaged via cams, and a valve spring 34 urging the intake valve 16 and the exhaust valve 17 to the closing direction. Driving systems for the intake valve 16 and for the exhaust valve 17 are constructed axisymmetrically relative to the axial line C of the cylinder 7.

Figure 3:
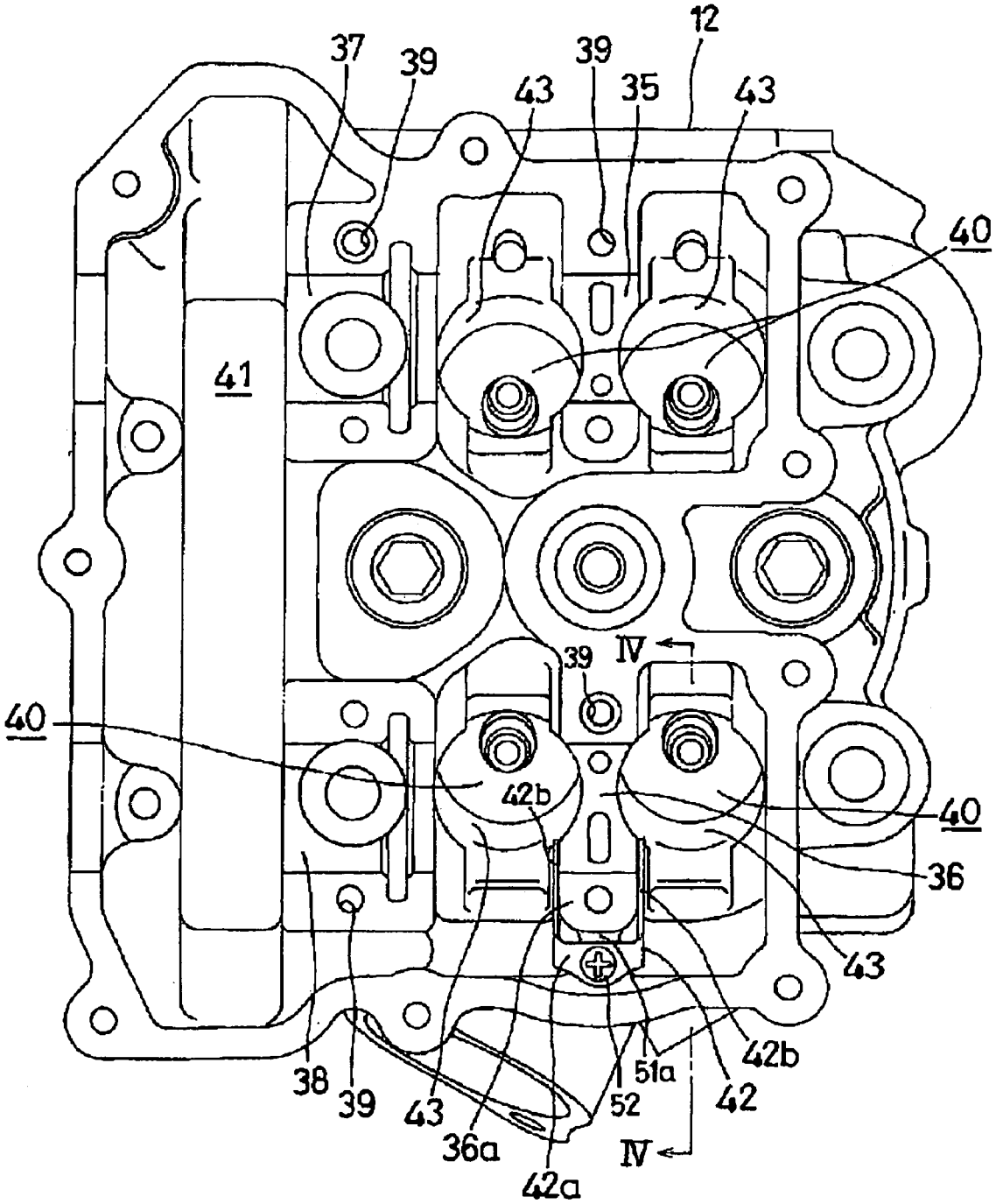
FIG. 3 is a front view of the cylinder head.

The intake cam shaft 31 and the exhaust cam shaft 32, with each axis line extending in the width direction of the scooter 6, are attached rotatably around its axis line and also in the removable manner by means of a cam cap (not shown) to the bearings 35 and 36 located to the left of the cylinder head 12 (refer to the FIG. 3) and to the bearings 37 and 38 located to the right of the cylinder head 12. The intake cam shaft 31 and the exhaust cam shaft 32 have cams 31*a* and 32*a* (refer to the FIG. 2 and the FIG. 4) respectively at two places. Note that FIG. 3 depicts the cylinder head 12 as it is viewed from the front of the scooter 6, thus the right side of the FIG. 3 represents the left side of the scooter. The bolt holes for screwing the fastening bolts to secure the cam cap to the cylinder head 12 are indicated by the reference numeral 39 in FIG. 3 and FIG. 4.

As shown in FIG. 3, the cam accommodating spaces 40 to the left and the right are formed on the cylinder head 12 in the places corresponding to the intake valves 16 and the exhaust valves 17, and the bearings 35 and 36 located to the left are provided between the left and the right cam accommodating spaces 40. The bearings 37 and 38 located to the right are provided between a timing chain accommodating space 41 formed in the right end of the cylinder head 12, and those cam accommodating spaces 40 located on the right among the left and the right cam accommodating spaces 40. A stopper 42, described in the sections below, is provided below the exhaust cam shaft bearing 36 that is one of the bearings 35 and 36 located on the left.

As shown in FIG. 4, the valve lifters 33 take the shape of a bottomed cylinder. Also, the valve lifters 33 are slidably fitted into valve lifter guide holes 43 in the cylinder head 12, with the cams 31*a* and 32*a* provided on the intake cam shaft 31 and the exhaust cam shaft 32 respectively being cam-engaged with their top faces 33*a*. The guide holes 43 are formed so that it is along the axial line with the intake valves 16 and the exhaust valves 17, and so that the end portion of the intake valves 16 and the exhaust valves 17 are internally engaging with them. Also, the guide holes 43 are open to the cam accommodating spaces 40 in the cylinder head 12, as shown in FIG. 3.

In addition, a shim 44 is interposed between the internal bottom face of the valve lifter 33 and valve stem 16*a* on the intake valves 16, and valve stem 17*a* on the exhaust valves 17 for adjusting the valve clearance.

As shown in FIG. 4, the valve spring 34 is provided between a spring retainer 46 attached to the stem end portion of each intake valve 16 and exhaust valve 17 via a cotter pin 45, and a spring seat 47 provided at the bottom of the guide hole 43.

The valve spring 34 is urging the intake valve 16 and the exhaust valve 17 to their closed position.

Figure 5:
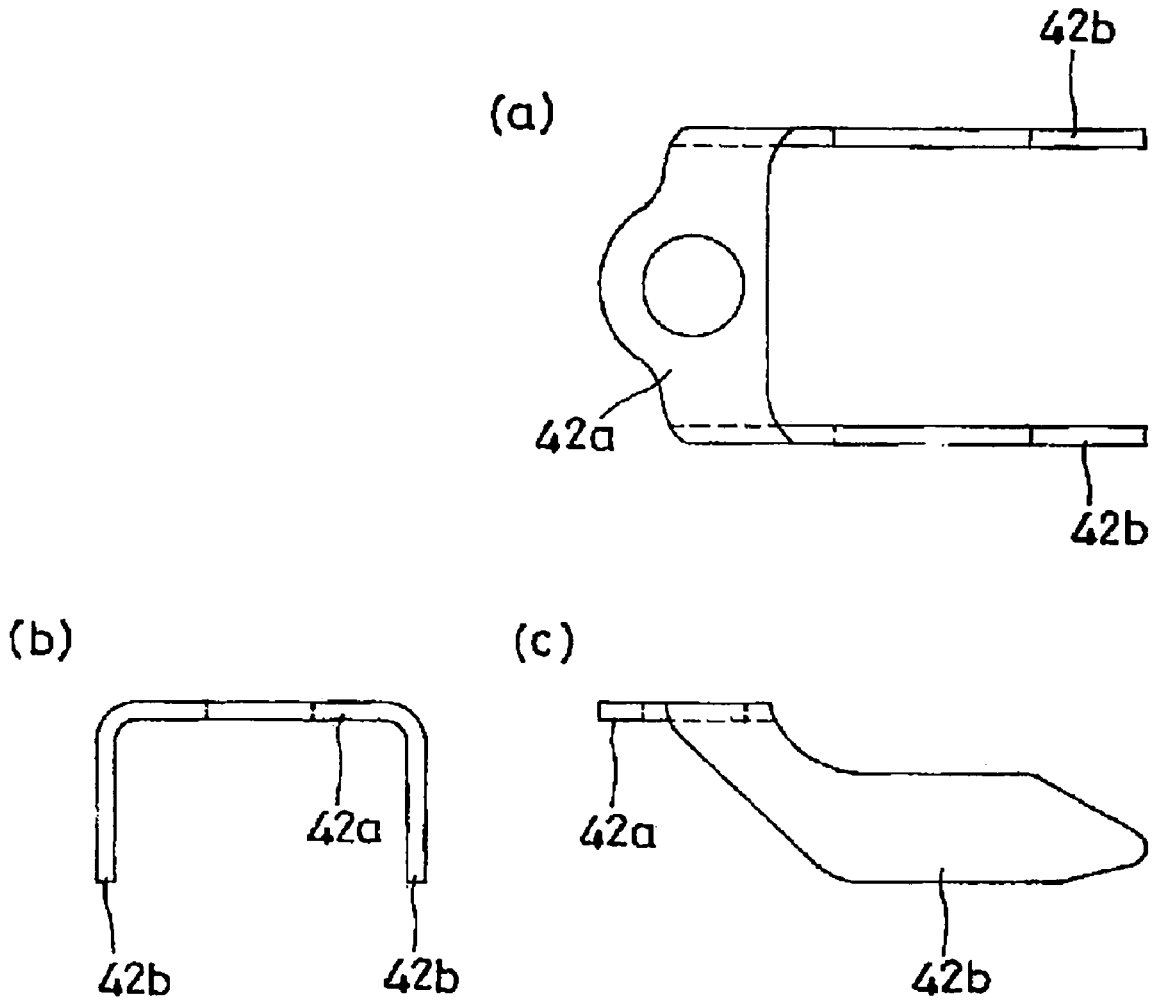
FIGS. 5(*a*)–5(*b*) shows a stopper, in which FIG. 5(*a*) shows its plan view, FIG. 5(*b*) shows its front view, and FIG. 5(*c*) shows its side view.

As shown in FIG. 3 through FIG. 5, the vertical wall 51 is extending downward from the left bearing 36 for the exhaust cam shaft 32, and the front end face 51*a* of the vertical wall 51 is included in the end area of the cylinder head 12 on the side of cylinder head cover 14. The stopper 42 is provided with a supporting plate 42*a* removably secured by the fastening screw 52 to the front end face 51*a* of the vertical wall 51, and stopper pieces 42*b* integrally formed on the supporting plate 42*a* at both ends along the scooter's width direction. The front end face 51*a* is formed so that it comes lower than a mating face 36*a* (refer to the FIG. 4) to which the cam cap on the bearing 36 is connected (so that it is located to the rear). Also, it is constructed such that head of the fastening screw 52 for securing the supporting plate 42*a* is in the position lower than the mating face 36*a*.

Each stopper piece 42*b* is provided extending to the rear and upward within the cam accommodating space 40 in parallel to both sides of the vertical wall 51 and the bearing 36.

As shown in FIG. 2 and FIG. 4, each stopper piece 42*b* on the stopper 42 is formed opposite to the top face 33*a* of each valve lifter 33 for the exhaust valves located lower than the axial line C of the cylinder 7. More specifically, as shown in FIG. 4, each stopper piece 42*b* is formed to be spaced from the top face 33*a* by a gap "d", and at the same time to face opposite to the top face 33*a*, when the circular base area of the cam 32*a* on the exhaust cam shaft 32 is cam-engaged with the top face 33*a* of the valve lifter 33 for the exhaust valve. In these two stopper pieces 42*b*, one stopper piece 42*b* located towards the right faces of the valve lifter 33 for the right exhaust valve, and the other stopper piece 42*b* located towards the left faces of the valve lifter 33 for the left exhaust valve.

In the engine 2 having the valve system 18 constructed as described above, the intake cam shaft 31 and the exhaust cam shaft 32 rotate, and then the valve lifters 33, the intake valves 16, and the exhaust valves 17 are driven to follow the rotation of the cam 31*a* and the cam 32*a* each provided on both of the cam shafts 31 and 32.

By the way, this engine 2 is kept mounted on the scooter 6 when its intake cam shaft 31 and/or the exhaust cam shaft 32 are replaced as part of the engine maintenance work or in some other situation. In such cases, once the exhaust cam shaft 32 is removed from the cylinder head 12, the valve lifter 33 for the exhaust valve tends to come down along the guide hole 43 by its own weight, however, the valve lifter 33 stops as it is abutted against the stopper 42 to prevent it from falling off the cylinder 7.

Thus, in the engine 2, the parts including the valve lifter 33 is kept assembled to the cylinder head 12 even when the exhaust cam shaft 32 is removed during the maintenance work.

Further, as described above, the shims 44 are interposed between the intake valves 16 and exhaust valves 17, and the internal bottom face of the valve lifter 33.

Since the shims 44 are a smaller part compared with the valve lifters 33, the shims 44 can be lost easily if they fall off together with the valve lifters 33. As described above, however, falling-off of the valve lifters 33 is prevented by the stopper 42, thus the shims 44 are prevented from falling off as well so as to prevent them from getting lost.

The invention claimed is:

1. A scooter engine, comprising:

valve lifters interposed between intake valves and a first cam shaft, as well as between exhaust valves and a second cam shaft, with an axial line of a cylinder extending toward a front part of a vehicle body; and a stopper opposing a top face of the valve lifters provided such that the stopper is secured removably in the cylinder and a gap is maintained between the top face and the stopper when a circular base area on the cam shafts is cam-engaged with the top face of the valve lifter.

2. The scooter engine according to claim 1, wherein shims are interposed between the intake valves and the exhaust valves, and internal bottom faces of the valve lifters.

3. The scooter engine according to claim 1, wherein a spring urges the intake valves and exhaust valves to a closing direction.

4. The scooter engine according to claim 1, wherein the intake valves and the exhaust valves are constructed symmetrical relative to the axial line.

5. The scooter engine according to claim 1, wherein first and second cam shafts are rotatably attached by a cam cap.

6. The scooter engine according to claim 1, wherein the stopper is located below an exhaust cam shaft bearing.

7. The scooter engine according to claim 1, wherein the valve lifters are shaped as a bottomed cylinder.

8. The scooter engine according to claim 1, wherein the valve lifters are fitted into valve lifter guide holes.

9. The scooter engine according to claim 8, wherein the valve lifter guide holes are formed on the axial line along with the intake valves and the exhaust valves.

10. The scooter engine according to claim 8, wherein the valve lifter guide holes open to a cam accommodating spaces.

11. A scooter engine, comprising:

valve lifters interposed between intake valves and a first cam shaft, as well as between exhaust valves and a second cam shaft, with an axial line of a cylinder extending toward a front part of a vehicle body;

a stopper opposing a top face of the valve lifters provided such that the stopper is secured removably in the cylinder and a gap is maintained between the top face and the stopper when a circular base area on the cam shafts is cam-engaged with the top face of the valve lifter; and means for urging the intake valves and the exhaust valves in a closed position.

12. The scooter engine according to claim 11, wherein shims are interposed between the intake valves and the exhaust valves, and internal bottom faces of the valve lifters.

13. The scooter engine according to claim 11, wherein valve lifter guide holes open to a cam accommodating spaces.

14. The scooter engine according to claim 11, wherein the intake valves and the exhaust valves are constructed symmetrical relative to the axial line.

15. The scooter engine according to claim 11, wherein first and second cam shafts are rotatably attached by a cam cap.

16. The scooter engine according to claim 11, wherein the stopper is located below an exhaust cam shaft bearing.

17. The scooter engine according to claim 11, wherein the valve lifters are shaped as a bottomed cylinder.

18. The scooter engine according to claim 11, wherein the valve lifters are fitted into valve lifter guide holes.

19. The scooter engine according to claim 18, wherein the valve lifter guide holes are formed on the axial line along with the intake valves and the exhaust valves.

20. A method for manufacturing a scooter engine, comprising:

interposing valve lifters between intake valves and a first cam shaft, as well as between exhaust valves and a second cam shaft, with an axial line of a cylinder extending toward a front part of a vehicle body;

positioning a stopper opposing a top face of the valve lifters such that the stopper is secured removably in the cylinder; and maintaining a gap between the top face and the stopper when a circular base area on the cam shafts is cam-engaged with the top face of the valve lifter.

* * * * *